US005485655A

United States Patent [19]

Wang

[11] Patent Number: 5,485,655

[45] Date of Patent: Jan. 23, 1996

[54] HINGE DEVICE FOR ARMRAILS OF A PLAYPEN

[76] Inventor: Kun Wang, No. 51, Lane 31, Sec. 2, Changping Rd., Taichung, Taiwan

[21] Appl. No.: 375,625

[22] Filed: Jan. 20, 1995

[51] Int. Cl.[6] ..... E05D 11/10; A47D 7/00

[52] U.S. Cl. ..... 16/371; 5/98.1; 5/99.1; 16/319; 16/321; 403/100

[58] Field of Search ..... 16/371, 367, 319, 16/321, 332, 333, 334, 344; 5/98.1, 99.1; 403/100, 101, 102

[56] References Cited

U.S. PATENT DOCUMENTS

| | | | |
|---|---|---|---|
| 4,721,125 | 1/1988 | Wang-Lee | 403/100 |
| 5,353,451 | 10/1994 | Hsiung | 5/98.1 |
| 5,367,725 | 11/1994 | Tsai | 5/98.1 |

*Primary Examiner*—P. Austin Bradley
*Assistant Examiner*—Adesh Bhargava
*Attorney, Agent, or Firm*—Kirkpatrick & Lockhart

[57] ABSTRACT

A hinge device for armrails of a playpen. The playpen includes an essentially rectangular upper support formed by four pairs of rods each centrally coupled by a hinge device, an essentially lower support formed by four rods each centrally coupled by a hinge and four corner rods pivotally engaged to each corner of the upper and the lower supports, the hinge device having two open ends each of which is defined by two side walls in each of which a first hole and a second hole are defined, a cut-away defined in an upper portion of the open end and communicating therewith, the rod having a bore defined by a periphery, with a third hole and a fourth hole defined in the periphery and a biasing element received in the bore with a protrusion extending out from said fourth holes, a plate fixedly engaged to a side of the hinge by a rivet and having two slender arms extending in a opposite directions, a finger extending longitudinally from each slender arm and having a boss extending laterally therefrom corresponding to the protrusion so as to eject the protrusion from the second hole by pushing the finger to allow the rod to be pivoted about an axis of the rivet.

3 Claims, 5 Drawing Sheets

HINGE DEVICE FOR ARMRAILS OF A PLAYPEN

BACKGROUND OF THE INVENTION

The present invention relates to a hinge device, and more particularly, to a hinge device for folding and extending the armrails of a playpen.

A conventional playpen or a cot comprises an essentially rectangular upper support formed by four pairs of rods each centrally coupled by a hinge, an essentially lower support formed by four rods each centrally coupled by a hinge and four corner rods pivotally engaged to each corner of the upper and the lower supports so as to allow the playpen to be folded by pivoting the rods of the upper support, the lower support and the four corner rods with respect to the hinges.

A hinge device is designed to maintain the rods connected thereto in a folded or an extended position and further has a feature of preventing the playpen or cot from collapsing by unintentional operation.

The present invention intends to provide a hinge device which has a feature of allowing slender arms thereof to be pushed in order that the playpen is folded.

SUMMARY OF THE INVENTION

The present invention provides a hinge device for armrails of a playpen with a rectangular upper support formed by four pairs of rods, each pair of rods centrally coupled by a hinge, the hinge having two open ends each of which is defined by two side walls and having a cut-away defined in an upper portion of each open end thereof for the rod pivotally engaged in the open end, a biasing element securely received in a bore of the rod and having a protrusion extending through a fourth hole defined in the rod and a second hole defined in the side wall to maintain a position of the rod in the hinge, a plate engaged to the side wall and having two slender arms each with a boss extending laterally corresponding to the protrusion so as to eject the protrusion from the second hole by pushing the slender arm to allow the rod to be pivoted with respect to the hinge.

It is an object of the present invention to provide a hinge device of a playpen which is folded or extended simply by pushing two slender arms engaged to the hinge device.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
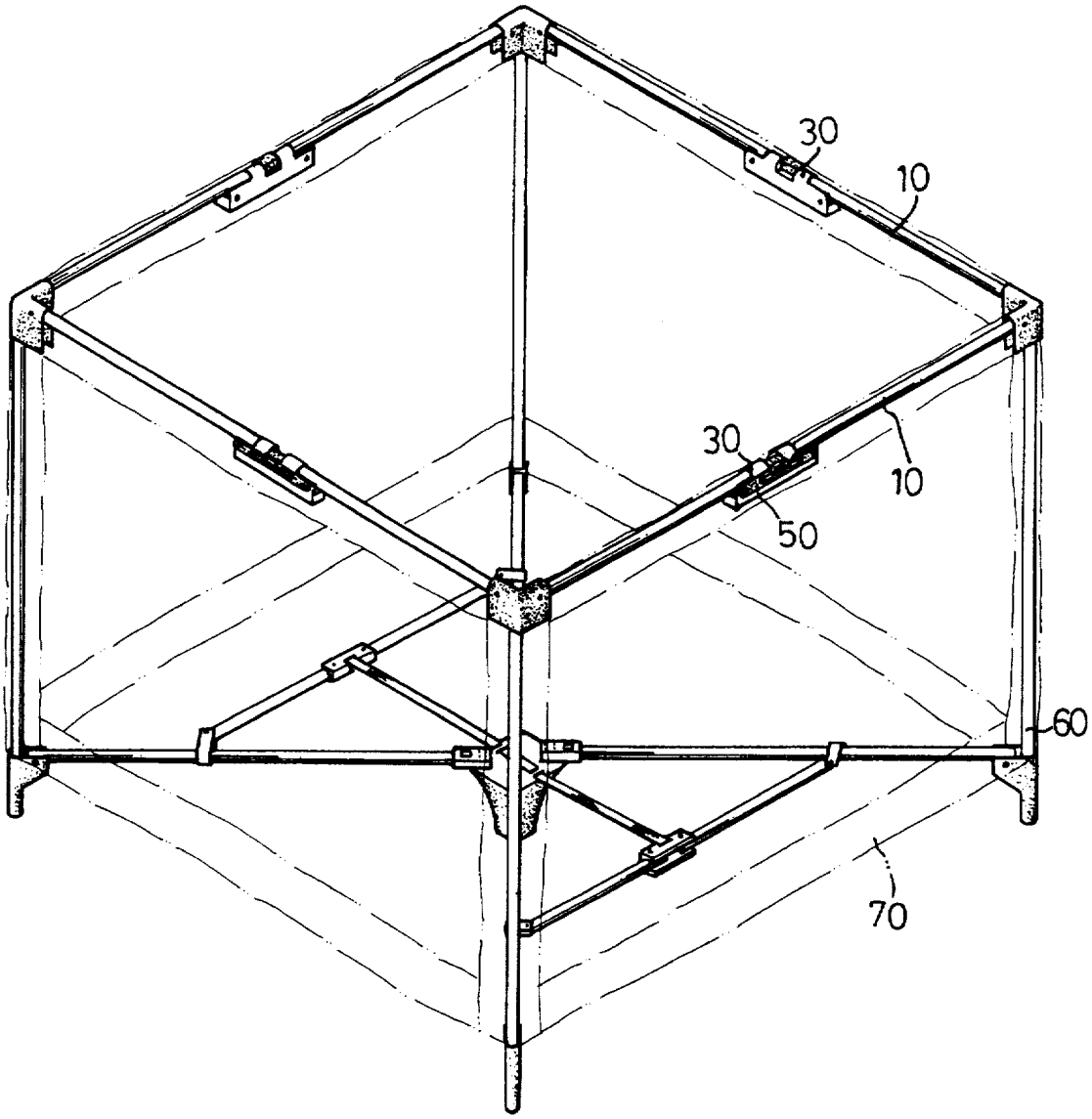
FIG. 1 is a perspective view of a playpen in accordance with the present invention wherein a fabric is mounted to the playpen and shown in phantom lines.
Figure 2:
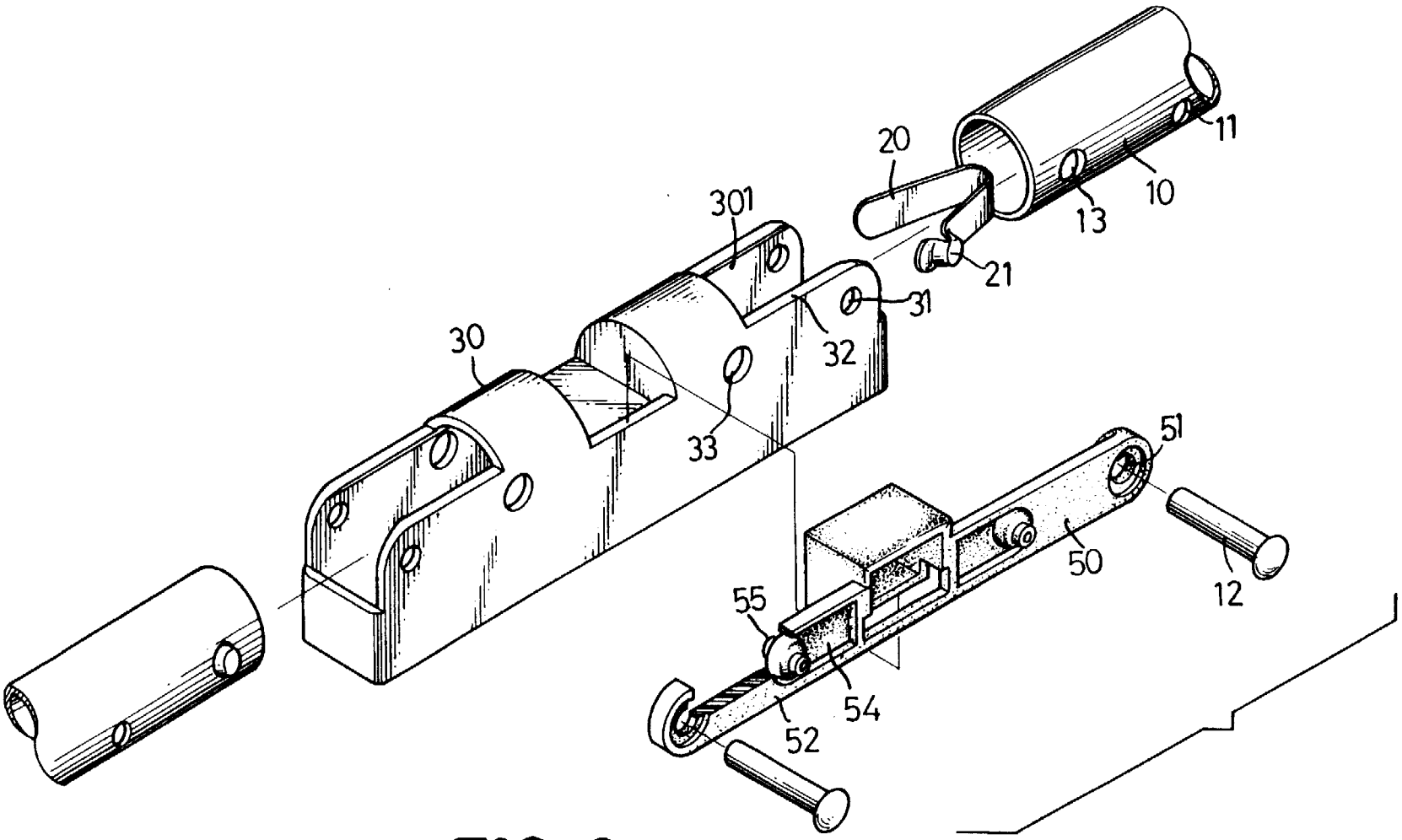
FIG. 2 is an exploded view of a hinge device in accordance with the present invention.
Figure 3:
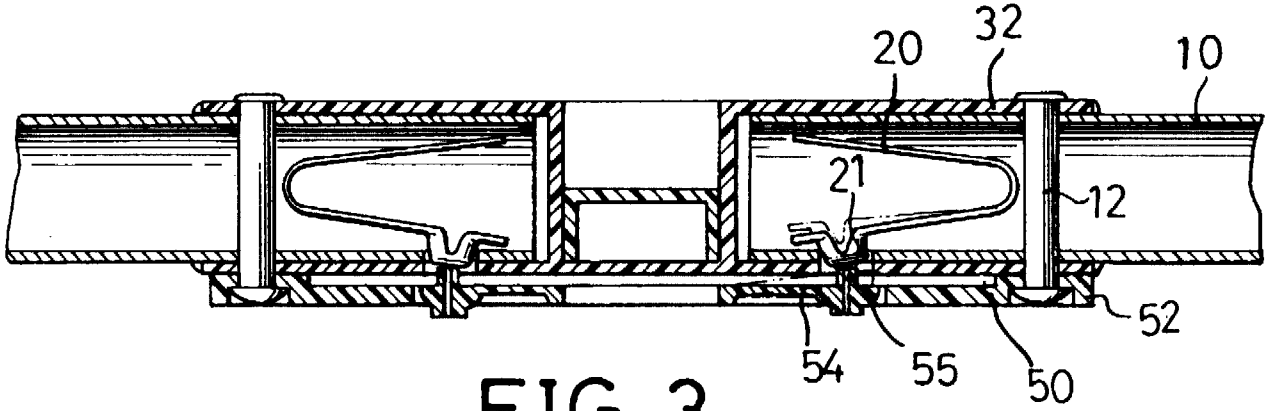
FIG. 3 is a top plane view, partly in section, of the engagement of the rods and the hinge device in accordance with the present invention.

Referring to the drawings and initially to FIGS. 1 through 3, a playpen includes an essentially rectangular upper support formed by four pairs of rods 10 each centrally coupled by a hinge 30, an essentially rectangular lower support formed by four rods (figures not shown) each centrally coupled by a hinge (not shown in the figures) and four corner rods 60 pivotally engaged to each corner of the upper and the lower supports, a fabric 70, shown in phantom lines, is folded around the upper and lower supports and the corner rods 60.

The hinge 30 is a U-shaped element and has two open ends each of which is defined by two side walls 32 in each of which a first hole 31 and a second hole 33 are defined and a cut-away 301 is defined in an upper portion of each end of the hinge 30 and communicates with the open end. The rod 10 has a first end received in a corresponding open end of the hinge 30, with a bore therethrough and two pairs of third and a fourth holes 11, 13 defined in a periphery thereof and each pair of the third and fourth holes 11, 13 are arranged on opposite sides of the periphery of the rod 10, a biasing element 20 is received in the bore of the rod 10, the biasing element 20 has a V-shaped configuration and has a protrusion 21 extending laterally from one distal end thereof. When the biasing element 20 is fixedly disposed in the bore of the rod 10 and the first end of the rod 10 is disposed in the open end of the hinge 30 the protrusion 21 of the biasing element 20 aligns with and extends through the fourth hole 13 and the second hole 33 respectively, thus locking the rod 10 in an extended position. A plate 50 has a central portion (not numbered) with two slender arms 52 extending therefrom in opposite directions. An engaging hole 51 is defined in a distal tip of each arm 52. A finger 54 has a first end extending integrally and longitudinally from each arm 52 and a second end having a boss 55 extending laterally therefrom and, the second end of the finger 54 defines a U-shaped gap between the finger 54 and the arm 52 so as to have a flexibility allowing the finger 54 to be pushed laterally. The bosses 55 correspond in position to protrusions 21, as best seen in FIG. 3 . The plate 50 is fixedly engaged to the side wall 32 of the hinge 30 by extending a rivet 12 through the engaging hole 51, the first hole 31 of the hinge 30 and the third hole 11 of the rod 10 such that the rod 10 is pivotally engaged to the hinge 30.

Figure 4:
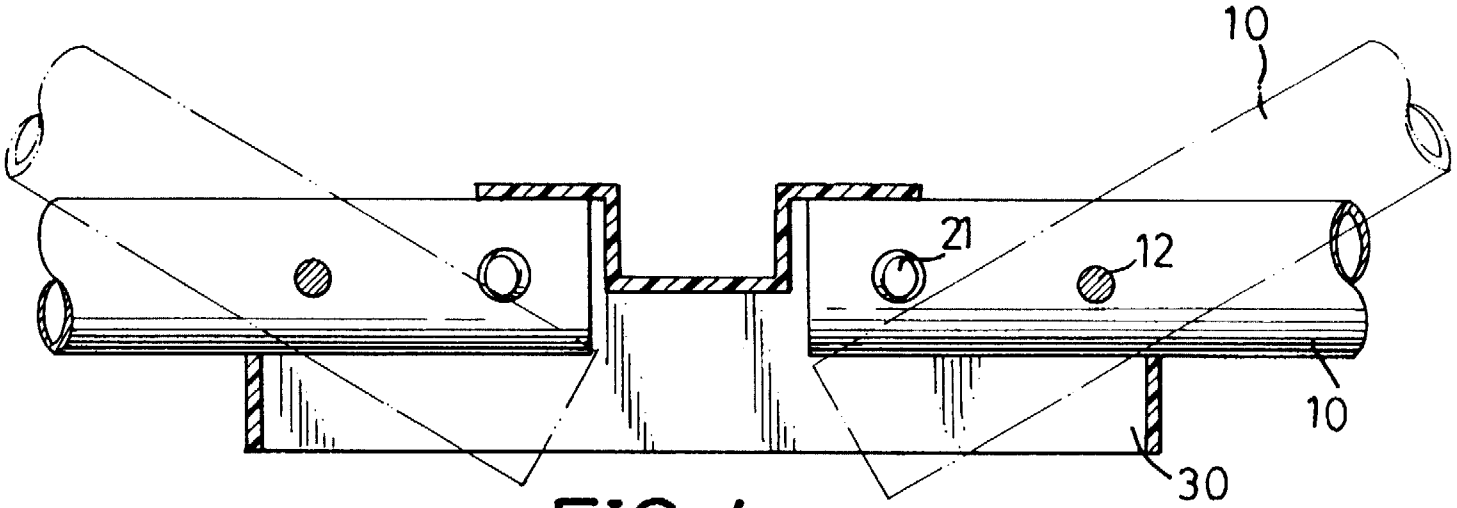
FIG. 4 is a side elevational view, partly in section, of the hinge device wherein the rods are pivoted about an axis of a corresponding rivet and are shown in phantom lines.
Figure 5:
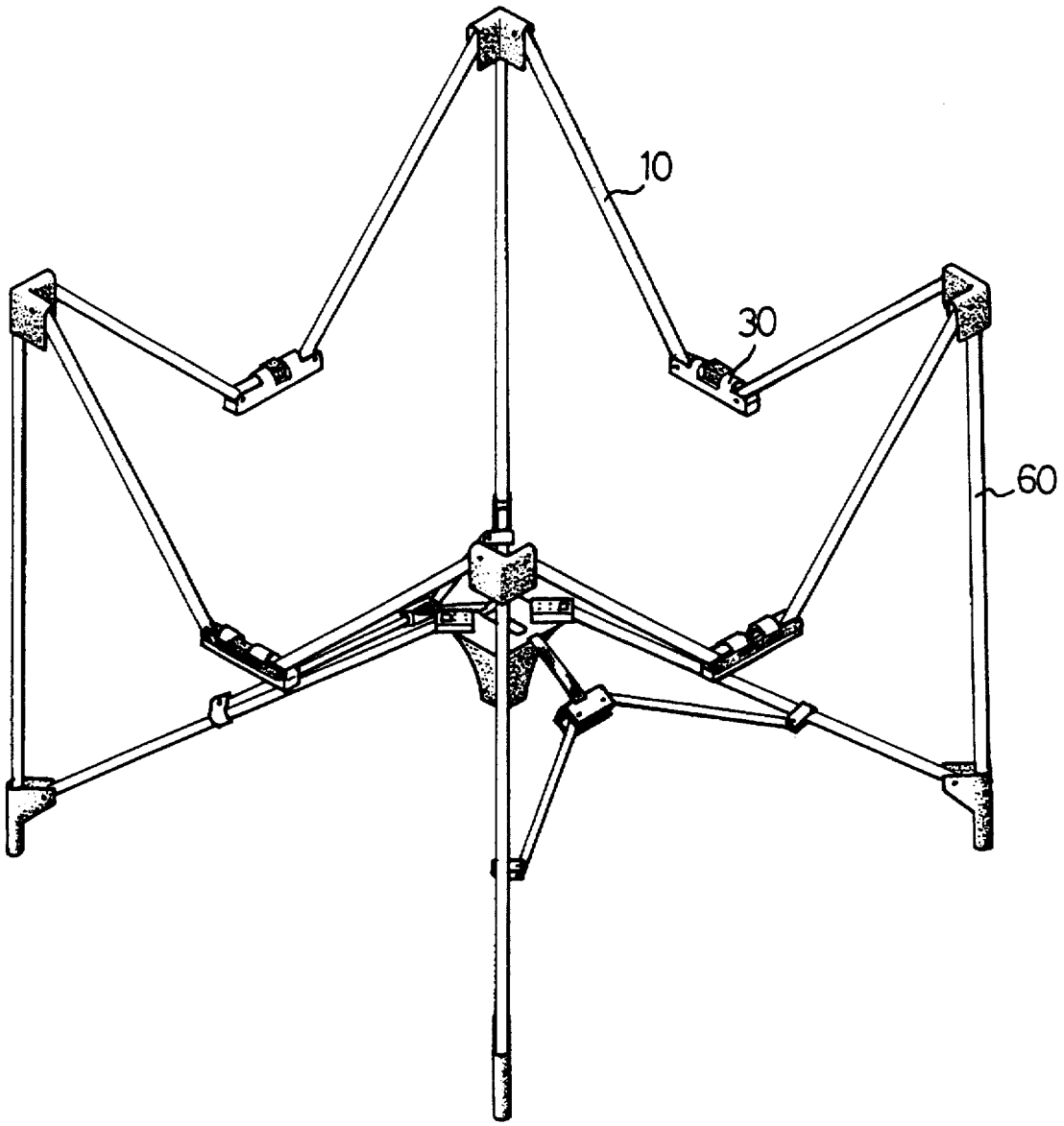
FIG. 5 is a perspective view of the playpen wherein the rods are pivoted at an angle corresponding to a horizontal line.
Figure 6:
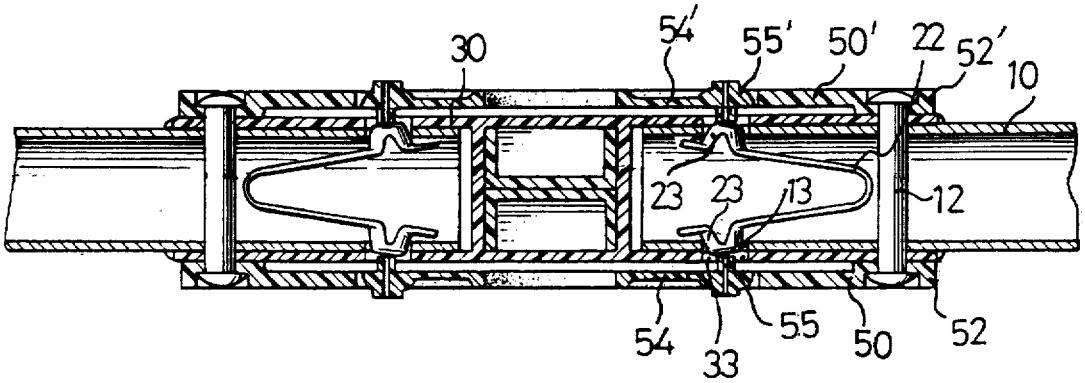
FIG. 6 is a top plane view of another embodiment of the engagement of the hinge device wherein a biasing element has two protrusions formed thereto.

Referring now to FIGS. 4 and 6, when operating the hinge 30, a user pushes the second end of the finger 54 to eject the protrusion 21 from the second hole 33 by the boss 55 so as to allow the rod 10 to be pivoted about an axis of the rivet 12 to fold the playpen shown as FIG. 4 and the rod 10 can be pivoted to be a vertical position and is received in the cut-away 301.

Accordingly, the present invention provides a hinge device of a playpen with a feature of pushing the fingers 54 to fold the playpen, this is important when operating the hinge device to avoid from hurting the user's hand and further to prevent a child from ejecting the protrusions 21 from the second hole 33 because of the biasing force.

Another embodiment of the present invention shown in FIG. 6 has a biasing element 22 similar to the biasing element 20 as described above but having a protrusion 23 which extends laterally from each of the two distal ends thereof, another plate 50' engaged to the other side of the hinge 30 and having the same structure as the plate 50, i.e. having two slender arms 52' from each of which a finger 54' extends and a boss 55' extends laterally from a second end of the finger 54'. Each of the protrusions 23 is received in a corresponding fourth hole 13 and second hole 33 of the rod 10 and the hinge 30 respectively and corresponds to the corresponding bosses 55, 55'. Therefore, the user has to push the fingers 54, 54' simultaneously to operate the hinge device, this ensures a safety operation process and prevents mis-operation.

Although the invention has been explained in relation to its preferred embodiment, it is to be understood that many other possible modifications and variations can be made without departing from the spirit and scope of the invention as hereinafter claimed.

I claim:

1. A hinge device for armrails of a playpen, said playpen having a plurality of armrails each composed of at least one pair of rods pivotally coupled by a hinge, said hinge being a U-shaped element having two open ends defined by two side walls, each side wall having a first hole and a second hole defined therein and each open end of said hinge having a cut-away defined in an upper portion thereof and communicating with said open end;

at least one plate having two slender arms engaged to a lateral side of said hinge, each slender arm having an engaging hole defined in a distal tip thereof and fixedly engaged to said plate, a finger having a first end extending integrally and longitudinally from each said slender arm and a second end having a boss extending laterally therefrom corresponding to said second hole of said hinge;

each rod of said armrail having a bore defined by a periphery in which a third hole and a fourth holes are laterally defined, said rod pivotally received in said open end of said hinge by a rivet extending through said engaging hole of said plate, said first hole of said hinge and said third hole of said rod, a biasing element received in said bore of said rod and having a protrusion extending therefrom and extending through said fourth hole of said rod and said second hole of said hinge and corresponding to said boss of said finger such that said second end of said finger can be pushed forward to said protrusion to eject said protrusion from said second hole of said hinge by said boss to allow said rod to be pivoted about an axis of said rivet and received in said cut-away of said hinge.

2. The hinge device as claimed in claim 1 wherein said biasing element is a V-shaped element which is fixedly disposed in said bore of said rod, said protrusion extends laterally from a distal end of said biasing element.

3. The hinge device as claimed in claim 2 wherein said biasing element has said protrusion extending laterally from both distal ends thereof.

* * * * *